US010400298B2

(12) United States Patent
Miyamoto et al.

(10) Patent No.: US 10,400,298 B2
(45) **Date of Patent: *Sep. 3, 2019**

(54) HIGH-CARBON HOT-ROLLED STEEL SHEET AND METHOD FOR PRODUCING THE SAME

(71) Applicant: JFE STEEL CORPORATION, Tokyo (JP)

(72) Inventors: Yuka Miyamoto, Kawasaki (JP); Takashi Kobayashi, Chiba (JP); Chikara Kami, Chiba (JP); Hayato Saito, Fukuyama (JP); Kaneharu Okuda, Kawasaki (JP)

(73) Assignee: JFE STEEL CORPORATION, Tokyo (JP)

( * ) Notice: Subject to any disclaimer, the term of this patent is extended or adjusted under 35 U.S.C. 154(b) by 395 days.

This patent is subject to a terminal disclaimer.

(21) Appl. No.: 14/903,842

(22) PCT Filed: Jul. 8, 2014

(86) PCT No.: PCT/JP2014/003605

§ 371 (c)(1),
(2) Date: Jan. 8, 2016

(87) PCT Pub. No.: WO2015/004902

PCT Pub. Date: Jan. 15, 2015

(65) Prior Publication Data

US 2016/0145709 A1 May 26, 2016

(30) Foreign Application Priority Data

Jul. 9, 2013 (JP) ..... 2013-143305
Jul. 9, 2013 (JP) ..... 2013-143307

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/60*** | (2006.01) |
| ***C21D 1/26*** | (2006.01) |
| ***C21D 6/00*** | (2006.01) |
| ***C22C 38/02*** | (2006.01) |
| ***C22C 38/04*** | (2006.01) |
| ***C22C 38/06*** | (2006.01) |
| ***C21D 1/74*** | (2006.01) |
| ***C21D 1/32*** | (2006.01) |

(52) U.S. Cl.

CPC ..... *C21D 9/46* (2013.01); *C21D 1/26* (2013.01); *C21D 1/32* (2013.01); *C21D 1/74* (2013.01); *C21D 6/005* (2013.01); *C21D 6/008* (2013.01); *C21D 8/0205* (2013.01); *C21D 8/0226* (2013.01); *C21D 8/0247* (2013.01); *C21D 8/0263* (2013.01); *C22C 38/00* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/60* (2013.01); *C21D 2211/003* (2013.01); *C21D 2211/005* (2013.01)

(58) Field of Classification Search

CPC ..... C21D 1/32; C21D 2211/003; C21D 2211/005; C21D 6/005; C21D 6/008; C21D 8/0205; C21D 8/0226; C21D 8/0263; C21D 9/46; C22C 38/00; C22C 38/001; C22C 38/002; C22C 38/008; C22C 38/02; C22C 38/04; C22C 38/06; C22C 38/08; C22C 38/12; C22C 38/18; C22C 38/32; C22C 38/60

See application file for complete search history.

(56) References Cited

U.S. PATENT DOCUMENTS

| | | | | |
|---|---|---|---|---|
| 2003/0041932 | A1 | 3/2003 | Tosaka et al. | |
| 2009/0065106 | A1 | 3/2009 | Kimura et al. | |
| 2009/0308504 | A1* | 12/2009 | Kariya | C22C 38/02 148/645 |
| 2010/0282376 | A1 | 11/2010 | Kimura et al. | |
| 2011/0017363 | A1 | 1/2011 | Kang et al. | |
| 2013/0186526 | A1 | 7/2013 | Nakamura et al. | |

FOREIGN PATENT DOCUMENTS

| | | | |
|---|---|---|---|
| CN | 1366558 | A | 8/2002 |
| CN | 101595234 | A | 12/2009 |
| CN | 101910439 | A | 12/2010 |
| CN | 102803541 | A | 11/2012 |
| EP | 1191114 | A1 | 3/2002 |
| EP | 1932933 | A1 | 6/2008 |
| EP | 2000552 | A2 | 12/2008 |
| EP | 2 128 289 | A1 | 12/2009 |
| EP | 2711439 | A1 | 3/2014 |

(Continued)

OTHER PUBLICATIONS

Oct. 25, 2017 Office Action issued in Korean Patent Application No. 2015-7035764.

(Continued)

*Primary Examiner* — Colleen P Dunn
*Assistant Examiner* — Anthony M Liang
(74) *Attorney, Agent, or Firm* — Oliff PLC

(57) ABSTRACT

There is provided is a high-carbon hot-rolled steel sheet and method for producing the same. The steel sheet has excellent hardenability consistently, even when annealed in a nitrogen atmosphere, and excellent formability. The steel sheet has a hardness in the range of 83 HRB or less and a total elongation of 30% or more before being subjected to a quenching treatment.

10 Claims, No Drawings

(56) References Cited

FOREIGN PATENT DOCUMENTS

| | | | | |
|---|---|---|---|---|
| JP | H07-268546 | A | | 10/1995 |
| JP | H09-87805 | A | | 3/1997 |
| JP | 2001-073033 | A | | 3/2001 |
| JP | 2004-250768 | A | | 9/2004 |
| JP | 2004-315836 | A | | 11/2004 |
| JP | 2007-029145 | A | | 2/2007 |
| JP | 2007-277696 | A | | 10/2007 |
| JP | 2007-291495 | A | | 11/2007 |
| JP | 2010-255066 | A | | 11/2010 |
| JP | 2010255066 | A | * | 11/2010 |
| JP | 5812048 | B2 | | 11/2015 |
| WO | 9806881 | A1 | | 2/1998 |
| WO | 01/062997 | A1 | | 8/2001 |
| WO | 2012157267 | A1 | | 11/2012 |
| WO | 2013102982 | A1 | | 7/2013 |
| WO | 2013102986 | A1 | | 7/2013 |

OTHER PUBLICATIONS

Apr. 13, 2017 Office Action issued in Japanese Patent Application No. 2013-143305.

Sep. 5, 2016 Office Action issued in Chinese Patent Application No. 201480039480.0.

Mar. 29, 2017 Office Action issued in Korean Patent Application No. 2015-7035764.

Jun. 14, 2017 Office Action issued in Chinese Patent Application No. 201480039480.0.

Jun. 13, 2017 Search Report issued in European Patent Application No. 17150099.4.

Jun. 1, 2016 Extended European Search Report issued in European Application No. PCT/JP2014/003605.

Sep. 6, 2016 Office Action in Japanese Patent Application No. 2013-143305.

Jan. 29, 2018 Office Action issued in U.S. Appl. No. 14/903,911.

Oct. 21, 2014 International Search Report issued in European Application No. PCT/JP2014/003605.

Jan. 5, 2016 Office Action issued in Japanese Application No. 2013-143305.

May 24, 2018 Office Action issued in U.S. Appl. No. 14/903,911.

Jul. 9, 2019 Office Action Issued in Chinese Patent Application No. 201810076655.5.

* cited by examiner

HIGH-CARBON HOT-ROLLED STEEL SHEET AND METHOD FOR PRODUCING THE SAME

TECHNICAL FIELD

This application relates to a high-carbon hot-rolled steel sheet with excellent hardenability and excellent formability and a method for producing such a high-carbon hot-rolled steel sheet, and particularly relates to a high-carbon hot-rolled steel sheet containing B which is capable of reducing the occurrence of nitriding in the surface layer of the steel sheet and a method for producing such a high-carbon hot-rolled steel sheet.

BACKGROUND

Automotive parts such as a gear, a transmission, and a seat recliner have been commonly produced by cold-working a hot-rolled steel sheet that is a carbon steel for machine structural use according to JISG4051 into a desired shape and subsequently performing a quenching treatment in order to achieve desired hardness. Accordingly, the hot-rolled steel sheets used as a material of such automotive parts have been required to have high cold formability and high hardenability, and various steel sheets have been proposed.

For example, Patent Literature 1 discloses a steel for machine structural use having high cold formability and high resistance to decarburization, the steel having a composition containing, by massa, C: 0.1% to 1.2%, Si: 0.01% to 2.5%, Mn: 0.1% to 1.5%, P: 0.04% or less (including 0%), S: 0.0005% to 0.05%, Al: 0.2% or less, one or two elements selected from Te: 0.0005% to 0.05% and Se: 0.0005% to 0.05%, N: 0.0005% to 0.03%, the total content of S and the one or two elements selected from Te and Se being 0.005% to 0.05%, and the balance being Fe and incidental impurities, the steel having a microstructure mainly composed of ferrite and pearlite, the crystal grain size number of ferrite according to JIS G 0552 being 11 or more. Patent Literature 1 also discloses a steel for machine structural use having a composition containing, in addition to the above-described constituents, Sb: 0.001 to 0.05%; a steel for machine structural use having a composition containing, in addition to the above-described constituents, one or more elements selected from Cr: 0.2% to 2.0%, Mo: 0.1% to 1.0%, Ni: 0.3% to 1.5%, Cu: 1.0% or less, and B: 0.005% or less; a steel for machine structural use having a composition containing, in addition to the above-described constituents, one or more elements selected from Ti: 0.002% to 0.05%, Nb: 0.005% to 0.1%, and V: 0.03% to 0.3%; and a steel for machine structural use having a composition containing, in addition to the above-described constituents, one or more elements selected from Mg: 0.0002% to 0.01%, Zr: 0.0001% to 0.01%, and Ca: 0.0002% to 0.008%. Patent Literature 1 further discloses a method for producing a steel for machine structural use having high cold formability and high resistance to decarburization, in which a steel having the above-described composition is hot-rough-rolled at 850° C. or more and 1000° C. or less, finish-rolled at 700° C. or more and 1000° C. or less, cooled to 500° C. or more and 700° C. or less at a cooling rate of 0.1° C./sec or more and less than 5° C./sec, immediately maintained in a furnace having an atmosphere temperature of 650° C. or more and 750° C. or less for 15 minutes or more and 90 minutes or less, and is allowed to cool.

Patent Literature 2 discloses a high-carbon steel sheet with high formability, high hardenability, high weldability, high resistance to carburization, and high resistance to decarburization, the steel having a composition containing, by mass %, C: 0.2% to 0.35%, Si: 0.03% to 0.3%, Mn: 0.15% to 1.2%, Cr: 0.02% to 1.2%, P: 0.02% or less, S: 0.02% or less, Mo: 0.2% or less, Ti: 0.01% to 0.10%, B: 0.0005% to 0.0050%, and one or more elements selected from Sn, Sb, Bi, and Se such that the total content of the one or more elements is 0.0003% to 0.5% or a composition containing, in addition to the above-described constituents, one or more elements selected from Ce: 0.05% or less, Ca: 0.05% or less, Zr: 0.05% or less, and Mg: 0.05% or less. Patent Literature 2 also discloses a method for producing a high-carbon steel sheet with high formability, high hardenability, high weldability, high resistance to carburization, and high resistance to decarburization, in which a steel having the above-described composition is hot-rolled with a finishing temperature of Ar3+10° C. to Ar3+50° C. and a coiling temperature of 550° C. to 700° C. and subsequently pickling is performed.

Patent Literature 3 discloses a high-carbon hot-rolled steel sheet having a composition containing, by mass %, C: 0.15% to 0.37%, Si: 1% or less, Mn: 2.5% or less, P: 0.1% or less, S: 0.03% or less, sol. Al: 0.1% or less, N: 0.0005% to 0.0050%, B: 0.0010% to 0.0050%, at least one element selected from Sb and Sn: 0.003% to 0.10% in total, and the balance being Fe and incidental impurities, in which 0.50 (14[B])/(10.8[N]) is satisfied, the high-carbon hot-rolled steel sheet having a microstructure including a ferrite phase and cementite, the average grain size of the ferrite phase being 10 μm or less, the spheroidizing ratio of the cementite being 90% or more, where [B] and [N] refer to the contents (mass %) of B and N, respectively. Patent Literature 3 also discloses a high-carbon hot-rolled steel sheet having a composition containing, in addition to the above-described constituents, at least one elements selected from Ti, Nb, and V: 0.1% or less in total; and a high-carbon hot-rolled steel sheet having a composition containing, in addition to the above-described constituents, at least one elements selected from Ni, Cr, and Mo: 1.5% or less in total. Patent Literature 3 further discloses a method for producing a high-carbon hot-rolled steel sheet, in which a steel having the above-described composition is hot-rolled with a finishing temperature of the Ar3 transformation temperature or more, cooled to a cooling stop temperature of 550° C. to 650° C. within 10 s, coiled at a coiling temperature of 500° C. to 650° C., pickled, and annealed at 640° C. or more and the Ac1 transformation temperature or less in order to spheroidize cementite. Patent Literature 3 also discloses a method for producing a high-carbon hot-rolled steel sheet, in which a steel having the above-described composition is hot-rolled with a finishing temperature of the Ar3 transformation temperature or more, cooled from 650° C. or more to a cooling stop temperature of 450° C. to 600° C. at an average cooling rate of 50° C./s or more, coiled within 3 s after being cooled, pickled, and annealed at 640° C. or more and the Ac1 transformation temperature or less in order to spheroidize cementite.

In the above-described steel sheets, the hardenability of the steel sheet is enhanced by using elements such as Mn, P, B, Cr, Mo, and Ni. For example, it is described in the technique disclosed in Patent Literature 3 that elements such as Mn, P, and B enhance the hardenability of a steel sheet.

CITATION LIST

Patent Literature

PTL 1: Japanese Unexamined Patent Application Publication No. 2004-250768

PTL 2: Japanese Unexamined Patent Application Publication No. 2004-315836

PTL 3: Japanese Unexamined Patent Application Publication No. 2010-255066

SUMMARY

Technical Problem

In order to achieve good cold formability, high-carbon hot-rolled steel sheets are required to have relatively low hardness and high ductility. For example, high-carbon hot-rolled steel sheets that are integrally formed into automotive parts, which have been previously produced through multiple steps such as hot forging, cutting, and welding, by cold pressing are required to have a Rockwell hardness HRB of 83 or less and a total elongation El of 30% or more. Such high-carbon hot-rolled steel sheets having good formability are also required to have high hardenability. For example, it is desired that such high-carbon hot-rolled steel sheets have a Vickers hardness of more than 620 HV after being water-quenched. In the case where the high-carbon hot-rolled steel sheets are required to have markedly high formability, it is desired that the high-carbon hot-rolled steel sheets have a Rockwell hardness HRB of 75 or less and a total elongation El of 38% or more. In such a case, as for hardenability, such high-carbon hot-rolled steel sheets are desired to have a Vickers hardness of 440 HV or more after being water-quenched instead of the Vickers hardness of more than 620 HV described above.

As described above, elements such as Mn, P, B, Cr, Mo, and Ni are used in order to achieve good hardenability. Among these elements that enhance hardenability, Mn and the like enhance hardenability, but increase the strength of a hot-rolled steel sheet due to solid solution strengthening, which disadvantageously increases hardness. In contrast, B is an element capable of enhancing the hardenability of a high-carbon hot-rolled steel sheet at low cost without significantly increasing the hardness of the steel sheet that has not been quenched.

Accordingly, the inventors have studied a method in which a steel having a low Mn content and containing B in order to enhance the hardenability of the steel is used as a material and spheroidizing annealing is performed in order to enhance cold formability. The inventors have studied, as a spheroidizing annealing treatment, a commonly used spheroidizing annealing treatment performed in a nitrogen atmosphere and found that it is impossible to enhance hardenability to a sufficient degree even when B is added to a steel. The inventors have also found that the hardness and ductility of a steel sheet that has been subjected to spheroidizing annealing (annealed sheet) are the factors that play an important role in achieving excellent cold formability and that, in order to achieve excellent cold formability, it is important to control the density of a carbide in the ferrite grains not only to control the average grain size of the ferrite phase and spheroidizing ratio as in Patent Literature 3.

The inventors have further found that the hardness and ductility of a steel sheet that has been subjected to spheroidizing annealing may vary. In particular, the ductility of the steel sheet may become insufficient when the finishing temperature of hot rolling is high.

An object of disclosed embodiments is to solve the above-described problems and to provide a high-carbon hot-rolled steel sheet to which B is added, the steel sheet having excellent hardenability consistently even when annealed in a nitrogen atmosphere and excellent formability, that is, specifically, a hardness of 83 HRB or less and a total elongation El of 30% or more, before being subjected to a quenching treatment, and a method for producing such a high-carbon hot-rolled steel sheet. Another object of the disclosed embodiments is to provide such a high-carbon hot-rolled steel sheet having further excellent formability, that is, specifically, a hardness of 75 HRB or less and a total elongation El of 38% or more, and a method for producing such a high-carbon hot-rolled steel sheet.

Solution to Problem

The inventors have conducted extensive studies of the relationship between conditions under which a high-carbon hot-rolled steel sheet is produced in which the Mn content is set to be relatively low, that is, 0.50% or less, and B is added to the steel and the formability and hardenability of the steel sheet and, as a result, found the following knowledge.

i) The hardness and total elongation (hereinafter, also referred to simply as "elongation") of a high-carbon hot-rolled steel sheet that has not been quenched are greatly affected by the density of cementite in the ferrite grains. It is necessary to limit the density of cementite in the ferrite grains to 0.15 particle/$\mu m^2$ or less in order to achieve a hardness of 83 HRB or less and a total elongation (El) of 30% or more. It is necessary to limit the density of cementite in the ferrite grains to 0.10 particle/$\mu m^2$ or less in order to set the hardness of a high-carbon hot-rolled steel sheet that has not been quenched to 75 HRB or less and the total elongation (El) of the steel sheet to 38% or more.

ii) The density of cementite in the ferrite grains is greatly affected by the finishing temperature of hot rolling. An excessively high finishing temperature results in difficulty in reducing the cementite density after spheroidizing annealing.

iii) When annealing is performed in a nitrogen atmosphere, nitriding may occur due to nitrogen contained in the atmosphere. In such a case, nitrogen concentrates in the steel sheet and combines with B contained in the steel sheet to form BN, which significantly reduces the solute B content in the steel sheet. The "nitrogen atmosphere" herein refers to an atmosphere having a nitrogen content of 90 vol % or more. Adding at least one element selected from Sb, Sn, Bi, Ge, Te, and Se to the steel prevents the occurrence of nitriding and a reduction in the solute B content in the steel sheet, which enhances hardenability.

The finishing temperature of hot rolling tends to be lower at the edge of the steel sheet in the width direction. Thus, properties of the steel sheet in the width direction have been studied and, as a result, the following knowledge has been found.

iv) The finishing temperature is more likely to decrease in the vicinity of the edge of the steel sheet in the width direction than at the center of the steel sheet in the width direction. This reduces the elongation of the steel sheet, deteriorates the formability of the steel sheet, and increases the variations in the hardness and elongation of the annealed steel sheet in the width direction. The above-described variations can be reduced by heating the edge of the steel sheet in the width direction using an edge heater in finish-rolling.

v) In particular, limiting the difference between the temperature at the center of the steel sheet in the width direction and the temperature at the edge of the steel sheet in the width direction to 40° C. or less using an edge heater reduces the variation in Rockwell hardness HRB of the steel sheet in the width direction to 4 HRB or less and the variation in the total elongation El of the steel sheet in the width direction to 3% or less.

Disclosed embodiments were made on the basis of the above-described knowledge. A summary of disclosed embodiments follows.

[1] A high-carbon hot-rolled steel sheet with excellent hardenability and excellent formability, the high-carbon hot-rolled steel sheet having a composition containing, by mass %, C: 0.20% or more and 0.53% or less, Si: 0.10% or less, Mn: 0.50% or less, P: 0.03% or less, S: 0.010% or less, sol. Al: 0.10% or less, N: 0.0050% or less, B: 0.0005% or more and 0.0050% or less, one or more elements selected from Sb, Sn, Bi, Ge, Te, and Se such that the total content of the one or more elements is 0.002% or more and 0.030% or less, and the balance containing Fe and incidental impurities, the high-carbon hot-rolled steel sheet having, when the C content is, by mass %, C: more than 0.40% and 0.53% or less, a microstructure including ferrite and cementite, the density of the cementite in the ferrite grains being 0.15 particle/$\mu m^2$ or less, a hardness of more than 65 HRB and 83 HRB or less, and a total elongation of 30% or more, the high-carbon hot-rolled steel sheet having, when the C content is, by mass %, C: 0.20% or more and 0.40% or less, a microstructure including ferrite and cementite, the density of the cementite in the ferrite grains being 0.10 particle/$\mu m^2$ or less, a hardness of more than 65 HRB and 75 HRB or less, and a total elongation of 38% or more.

[2] The high-carbon hot-rolled steel sheet with excellent hardenability and excellent formability described in [1], wherein the C content is, by mass %, C: more than 0.40% and 0.53% or less, and the high-carbon hot-rolled steel sheet has a microstructure including ferrite and cementite, the density of the cementite in the ferrite grains being 0.15 particle/$\mu m^2$ or less, a hardness of more than 65 HRB and 83 HRB or less, and a total elongation of 30% or more.

[3] The high-carbon hot-rolled steel sheet with excellent hardenability and excellent formability described in [1], wherein the C content is, by mass %, C: 0.20% or more and 0.40% or less, and the high-carbon hot-rolled steel sheet has a microstructure including ferrite and cementite, the density of the cementite in the ferrite grains being 0.10 particle/$\mu m^2$ or less, a hardness of more than 65 HRB and 75 HRB or less, and a total elongation of 38% or more.

[4] The high-carbon hot-rolled steel sheet with excellent hardenability and excellent formability described in any one of [1] to [3], wherein the composition further contains at least one element selected from Ni, Cr, and Mo such that the total content of the at least one element is, by mass %, 0.50% or less.

[5] The high-carbon hot-rolled steel sheet with excellent hardenability and excellent formability described in any one of [1] to [4], wherein a variation in HRB hardness in the width direction of the steel sheet is 4 or less and a variation in total elongation in the width direction of the steel sheet is 3% or less.

[6] A method for producing a high-carbon hot-rolled steel sheet with excellent hardenability and excellent formability, the method including subjecting a steel having a composition containing, by mass %, C: 0.20% or more and 0.53% or less, Si: 0.10% or less, Mn: 0.50% or less, P: 0.03% or less, S: 0.010% or less, sol. Al: 0.10% or less, N: 0.0050% or less, B: 0.0005% or more and 0.0050% or less, one or more elements selected from Sb, Sn, Bi, Ge, Te, and Se such that the total content of the one or more elements is 0.002% or more and 0.030% or less, and the balance containing Fe and incidental impurities to hot-rough-rolling, finish-rolling at a finishing temperature of the Ar3 transformation temperature or more and (the Ar3 transformation temperature+90° C.) or less, coiling at a coiling temperature of 500° C. or more and 700° C. or less, and annealing at the Ac1 transformation temperature or less, thereby producing the high-carbon hot-rolled steel sheet having, when the C content in the steel is, by mass %, C: more than 0.40% and 0.53% or less, a microstructure including ferrite and cementite, the density of the cementite in the ferrite grains being 0.15 particle/$\mu m^2$ or less, a hardness of more than 65 HRB and 83 HRB or less, and a total elongation of 30% or more, and the high-carbon hot-rolled steel sheet having, when the C content in the steel is, by mass %, C: 0.20% or more and 0.40% or less, a microstructure including ferrite and cementite, the density of the cementite in the ferrite grains being 0.10 particle/$\mu m^2$ or less, a hardness of more than 65 HRB and 75 HRB or less, and a total elongation of 38% or more.

[7] The method for producing a high-carbon hot-rolled steel sheet with excellent hardenability and excellent formability described in [6], wherein the C content in the steel is, by mass %, C: more than 0.40% and 0.53% or less, and the high-carbon hot-rolled steel sheet having a microstructure including ferrite and cementite, the density of the cementite in the ferrite grains being 0.15 particle/$\mu m^2$ or less, a hardness of more than 65 HRB and 83 HRB or less, and a total elongation of 30% or more is produced.

[8] The method for producing a high-carbon hot-rolled steel sheet with excellent hardenability and excellent formability described in [6], wherein the C content in the steel is, by mass %, C: 0.20% or more and 0.40% or less, and the high-carbon hot-rolled steel sheet having a microstructure including ferrite and cementite, the density of the cementite in the ferrite grains being 0.10 particle/$\mu m^2$ or less, a hardness of more than 65 HRB and 75 HRB or less, and a total elongation of 38% or more is produced.

[9] The method for producing a high-carbon hot-rolled steel sheet with excellent hardenability and excellent formability described in any one of [6] to [8], wherein the steel further contains, by mass %, at least one element selected from Ni, Cr, and Mo such that the total content of the at least one element is 0.50% or less.

[10] The method for producing a high-carbon hot-rolled steel sheet with excellent hardenability and excellent formability described in any one of [6] to [9], wherein an edge heater is used in the finish-rolling.

[11] The method for producing a high-carbon hot-rolled steel sheet with excellent hardenability and excellent formability described in [10], wherein, in the finish-rolling, the difference between a finishing temperature at the center of the steel sheet in the width direction thereof and a finishing temperature at a position 10 mm from an edge of the steel sheet in the width direction thereof is set to be 40° C. or less using an edge heater.

Advantageous Effects

According to embodiments, a high-carbon hot-rolled steel sheet with excellent hardenability and excellent cold formability (formability) can be produced. The high-carbon hot-rolled steel sheet according to embodiments can be suitably used as a material of automotive parts such as a gear, a transmission, a seat recliner, and a hub, whose material, that is, steel sheet, is required to have high cold formability. The high-carbon hot-rolled steel sheet according to embodiments is also suitably used in order to increase the yield of the steel sheet used as a material because the properties of the high-carbon hot-rolled steel sheet according to embodiments is uniform over the entire width thereof.

DETAILED DESCRIPTION

The high-carbon hot-rolled steel sheet according to embodiments and a method for producing the high-carbon hot-rolled steel sheet are described below in detail. Note that, when referring to a composition, the unit "%" always refers to "mass %" unless otherwise specified.

1) Chemical Composition

C: 0.20% or More and 0.53% or Less

C is an element important for increasing the strength of a quenched steel sheet (i.e. steel sheet formed into a desired shape by cold-working and subsequently quenched). As described above, in the case where a steel sheet having a hardness of 83 HRB or less and a total elongation (El) of 30% or more is produced, it is desired that the hardness of the steel sheet be more than 620 HV after water quenching. If the C content is 0.40% or less, it is impossible to achieve the hardness of more than 620 HV after water quenching by performing a heat treatment after the steel sheet is formed into parts. Accordingly, in the case where a steel sheet having a hardness of 83 HRB or less and a total elongation (El) of 30% or more is produced, it is necessary to limit the C content to more than 0.40% in order to achieve a hardness of more than 620 HV after water quenching. However, if the C content exceeds 0.53%, the hardness of the steel sheet becomes excessively high, which deteriorates the toughness and cold formability of the steel sheet. Accordingly, in the case where a steel sheet having a hardness of 83 HRB or less and a total elongation (El) of 30% or more is produced, the C content is limited to more than 0.40% and 0.53% or less. The C content is preferably set to 0.51% or less because some parts are required to have markedly high formability and degradation in formability tends to easily occur if the C content exceeds 0.51%. When the C content is 0.45% or more, a steel sheet having the desired hardness (hardness of more than 620 HV after water quenching) can be produced with certainty. Accordingly, the C content is preferably set to 0.45% or more. Thus, in this case, the C content is preferably set to 0.45% or more and 0.51% or less.

As described above, C is an element important for increasing the strength of a quenched steel sheet. In the case where a steel sheet having a Rockwell hardness HRB of 75 or less and a total elongation El of 38% or more is produced, it is desired that the Vickers hardness of the steel sheet be 440 HV or more after water quenching. If the C content is less than 0.20%, it is impossible to achieve the hardness of 440 HV or more after water quenching by performing a heat treatment after the steel sheet is formed into parts. Accordingly, in the case where a steel sheet having a hardness of 75 HRB or less and a total elongation El of 38% or more is produced, it is necessary to limit the C content to 0.20% or more in order to achieve a hardness of 440 HV or more after water quenching. However, if the C content exceeds 0.40%, the hardness of the steel sheet becomes excessively high, which deteriorates the toughness and cold formability of the steel sheet. As a result, it becomes impossible to produce a steel sheet having a hardness of 75 HRB or less and a total elongation of 38% or more consistently. Accordingly, in the case where a steel sheet having a hardness of 75 HRB or less and a total elongation El of 38% or more is produced, the C content is limited to 0.20% or more and 0.40% or less. The C content is preferably set to 0.26% or more in order to produce a steel sheet having high hardness by quenching. The C content is further preferably set to 0.32% or more in order to achieve a hardness of 440 HV or more by water quenching consistently.

On the basis of the above-described facts, in disclosed embodiments, the C content is limited to 0.20% or more and 0.53% or less. In the case where a steel sheet having a hardness of 83 HRB or less and a total elongation (El) of 30% or more is produced, the C content is limited to more than 0.40% and 0.53% or less. In the case where a steel sheet having a hardness of 75 HRB or less and a total elongation El of 38% or more is produced, the C content is limited to 0.20% or more and 0.40% or less.

Si: 0.10% or Less

Si is an element that increases the strength of a steel by solid solution strengthening. However, the higher the Si content, the higher the hardness of a steel sheet, which deteriorates the cold formability of the steel sheet. Accordingly, the Si content is limited to 0.10% or less, is preferably set to 0.05% or less, and is more preferably set to 0.03% or less. Since Si deteriorates the cold formability of a steel sheet, the Si content is preferably set to a minimum. However, excessively reducing the Si content increases the cost required for refining. Thus, the Si content is preferably set to 0.005% or more.

Mn: 0.50% or Less

Mn is an element that enhances the hardenability of a steel, but Mn is also an element that increases the strength of a steel by solid solution strengthening. If the Mn content exceeds 0.50%, the hardness of a steel sheet becomes excessively high, which deteriorates the cold formability of the steel sheet. Moreover, if the Mn content exceeds 0.50%, a band structure due to segregation of Mn may be developed, which results in nonuniformity in the steel microstructure. As a result, the variations in the hardness and elongation of the steel sheet may be increased. Accordingly, the Mn content is limited to 0.50% or less, is preferably set to 0.45% or less, and is more preferably set to 0.40% or less. The lower limit of the Mn content is not particularly placed. However, the Mn content is preferably set to 0.20% or more in order to achieve the predetermined hardness of the steel sheet by that precipitation of graphite is suppressed and that all the C content in the steel sheet is dissolved in the form of solute in a solution treatment performed during quenching.

P: 0.03% or Less

P is an element that increases the strength of a steel by solid solution strengthening. If the P content exceeds 0.03%, the hardness of the steel sheet becomes excessively high, which deteriorates the cold formability of the steel sheet. In addition, intergranular embrittlement may occur, which deteriorates the toughness of the quenched steel sheet. Accordingly, the P content is limited to 0.03% or less. In order to increase the toughness of the quenched steel sheet, the P content is preferably set to 0.02% or less. Since P deteriorates the cold formability of the steel sheet and the toughness of the quenched steel sheet, the P content is preferably set to a minimum. However, excessively reducing the P content increases the cost required for refining. Thus, the P content is more preferably set to 0.005% or more.

S: 0.010% or Less

It is necessary to reduce the S content because S is an element that forms a sulfide, which deteriorates the cold formability of the high-carbon hot-rolled steel sheet and the toughness of the quenched steel sheet. If the S content exceeds 0.010%, the cold formability of the high-carbon hot-rolled steel sheet and the toughness of the quenched steel sheet become significantly degraded. Accordingly, the S content is limited to 0.010% or less. In order to enhance the cold formability of the steel sheet and the toughness of the quenched steel sheet, the S content is preferably set to 0.005% or less. The S content is preferably set to a minimum because S deteriorates the cold formability of the steel sheet and the toughness of the quenched steel sheet. However, excessively reducing the S content increases the cost required for refining. Thus, the S content is more preferably set to 0.0005% or more.

Sol. Al: 0.10% or Less

If the sol. Al (acid-soluble aluminium) content exceeds 0.10%, AlN is formed when the steel sheet is heated in the quenching treatment, which excessively reduces the size of the austenite grains. As a result, formation of the ferrite phase is promoted when the steel sheet is cooled in the quenching treatment and a microstructure composed of ferrite and martensite is formed, which deteriorates the hardness and toughness of the quenched steel sheet. Accordingly, the sol. Al content is limited to 0.10% or less and is preferably set to 0.06% or less. Sol. Al also causes deoxidation to occur. In order to increase the degree of deoxidation to a sufficient level, the sol. Al content is preferably set to 0.005% or more.

N: 0.0050% or Less

If the N content exceeds 0.0050%, BN may be formed, which reduces the solute B content. Moreover, if the N content exceeds 0.0050%, BN and AlN may be formed, which excessively reduces the size of the austenite grains while the steel sheet is heated in the quenching treatment. As a result, formation of the ferrite phase is promoted while the steel sheet is cooled in the quenching treatment, which deteriorates the hardness and toughness of the quenched steel sheet. Accordingly, the N content is limited to 0.0050% or less. The lower limit of the N content is not particularly placed. However, the N content is preferably set to 0.0005% or more since, as described above, N is an element that forms BN and AlN and thereby limits the growth of the austenite grains to an appropriate level while the steel sheet is heated in the quenching treatment, which enhances the toughness of the quenched steel sheet.

B: 0.0005% or More and 0.0050% or Less

B is an element important for enhancing hardenability. However, the advantageous effect is not obtained to a sufficient degree if the B content is less than 0.0005%. Thus, it is necessary to limit the B content to 0.0005% or more. The B content is preferably set to 0.0010% or more. If the B content exceeds 0.0050%, occurrence of recrystallization of austenite after finish-rolling may be delayed, and as a result, the texture of the hot-rolled steel sheet develops and the anisotropy of the annealed steel sheet increases. A large anisotropy of the annealed steel sheet increases the risk of occurrence of earring when the steel sheet is subjected to drawing. Moreover, in the case where the steel sheet is formed into cylindrical parts such as a gear and a transmission by cold pressing, a large anisotropy of the steel sheet makes it impossible to achieve sufficiently high circularity of the parts. If the circularity of the steel sheet that has been subjected to cold pressing is not sufficiently high, for example, it becomes impossible to apply integrally forming by cold pressing to the parts such as a gear and a transmission which are required to have high circularity. Accordingly, it is necessary to limit the B content to 0.0050% or less. The B content is preferably set to 0.0035% or less. Thus, the B content is limited to 0.0005% or more and 0.0050% or less and is preferably set to 0.0010% or more and 0.0035% or less.

One or More Elements Selected from Sb, Sn, Bi, Ge, Te, and Se: 0.002% or More and 0.030% or Less in Total Sb, Sn, Bi, Ge, Te, and Se are elements important for suppressing the occurrence of nitriding at the surface layer of a steel sheet. However, the advantageous effect is not obtained to a sufficient degree if the total content of these elements is less than 0.002%. Accordingly, the steel sheet contains one or more elements selected from Sb, Sn, Bi, Ge, Te, and Se and the lower limit of the total content of these elements is set to 0.002%. The lower limit of the total content of these elements is preferably set to 0.005%. On the other hand, the effect of suppressing nitriding saturates if the total content of these elements exceeds 0.030%. Furthermore, if the total content of these elements exceeds 0.030%, intergranular embrittlement may occur due to the excessively high content because these elements are likely to segregate at grain boundaries. Accordingly, the upper limit of the total content of Sb, Sn, Bi, Ge, Te, and Se is set to 0.030%. The total content of Sb, Sn, Bi, Ge, Te, and Se is preferably set to 0.020% or less. Thus, the steel sheet contains one or more elements selected from Sb, Sn, Bi, Ge, Te, and Se and the total content of these elements is limited to 0.002% or more and 0.030% or less. The total content of Sb, Sn, Bi, Ge, Te, and Se is preferably set to 0.005% or more and 0.020% or less.

In disclosed embodiments, as described above, the total content of one or more elements selected from Sb, Sn, Bi, Ge, Te, and Se is limited to 0.002% or more and 0.030% or less. This limits occurrence of nitriding at the surface layer of the steel sheet and an increase in the nitrogen concentration in the surface layer of the steel sheet even when the steel sheet is annealed in a nitrogen atmosphere. As a result, it becomes possible to reduce the difference between the content of nitrogen in a portion of the steel sheet which extends from the surface layer of the steel sheet to the depth of 150 μm in the thickness direction and the average nitrogen content over the entire steel sheet to 30 mass ppm or less. Since occurrence of nitriding can be suppressed in the above-described manner, it is possible to let solute B exist in the annealed steel sheet even when the steel sheet is annealed in a nitrogen atmosphere. This makes it possible to set the ratio of the solute B content in the steel sheet to the content of B added to the steel sheet, that is, {(Solute B content)/(Added B content)}×100(%), to 70(%) or more, where "Added B content" refers to the content of B in the steel.

The balance of the composition of the steel sheet includes Fe and incidental impurities. The steel sheet may contain at least one element selected from Ni, Cr, and Mo such that the total content of these elements is 0.50% or less in order to further enhance hardenability. That is, the steel sheet may contain at least one element selected from Ni, Cr, and Mo such that the total content of Ni, Cr, and Mo is 0.50% or less. Since Ni, Cr, and Mo are expensive, the total content of Ni, Cr, and Mo is preferably set to 0.20% or less in order to limit an increase in the cost. The total content of Ni, Cr, and Mo is preferably set to 0.01% or more in order to obtain the above-described advantageous effect.

2) Microstructure

In embodiments, in order to enhance cold formability, it is necessary to form a microstructure including ferrite and cementite by performing spheroidizing annealing of cementite subsequent to hot rolling. In particular, in the case where the C content is more than 0.40% and 0.53% or less, it is necessary to limit the density of cementite in the ferrite grains to 0.15 particle/$\mu m^2$ or less in order to produce a steel sheet having a hardness of 83 HRB or less and a total elongation of 30% or more. In particular, in the case where the C content is 0.20% or more and 0.40% or less, it is necessary to limit the density of cementite in the ferrite grains to 0.10 particle/$\mu m^2$ or less in order to produce a steel sheet having a hardness of 75 HRB or less and a total elongation of 38% or more.

Density of Cementite in Ferrite Grains: 0.15 Particle/$\mu m^2$ or Less when C Content is C: More than 0.40% and 0.53% or Less; and 0.10 Particle/$\mu m^2$ or Less when C Content is C: 0.20% or More and 0.40% or Less The steel sheet according to embodiments includes ferrite and cementite. If the density of cementite in the ferrite grains is high, the hardness of the steel sheet increases due to dispersion strengthening, and as a result, the elongation of the steel sheet is reduced. In the case where the C content is more than 0.40% and 0.53% or less, it is necessary to limit the density of cementite in the grains to 0.15 particle/$\mu m^2$ or less in order to produce a steel sheet having a hardness of 83 HRB or less and a total elongation of 30% or more. The density of cementite in the grains is preferably set to 0.13 particle/$\mu m^2$ or less and is further preferably set to 0.10 particle/$\mu m^2$ or less. The density of cementite in the ferrite grains may also be set to 0 particle/$\mu m^2$. The major-axis diameter of cementite particles that are present in the ferrite grains is about 0.15 to 1.8 μm, at which the cementite particles cause precipitation strengthening of the steel sheet to occur in an effective manner. Thus, the strength of the steel sheet according to embodiments can be reduced by reducing the density of cementite in the grains. However, the contribution of cementite particles that are present at the ferrite grain boundaries to dispersion strengthening is negligibly small. Thus, the density of cementite within the ferrite grains is limited to 0.15 particle/$\mu m^2$ or less.

In the case where the C content is 0.20% or more and 0.40% or less, it is necessary to limit the density of cementite in the ferrite grains to 0.10 particle/$\mu m^2$ or less in order to produce a steel sheet having a hardness of 75 HRB or less and a total elongation of 38% or more. The density of cementite in the ferrite grains is preferably set to 0.08 particle/$\mu m^2$ or less and is further preferably set to 0.06 particle/$\mu m^2$ or less. The density of cementite in the ferrite grains may also be set to 0 particle/$\mu m^2$. The major-axis diameter of cementite particles that are present in the ferrite grains is about 0.15 to 1.8 μm, at which the cementite particles cause precipitation strengthening of the steel sheet to occur in an effective manner. Thus, the strength of the steel sheet can be reduced by reducing the density of cementite in the grains. However, the contribution of cementite particles that are present at the ferrite grain boundaries to dispersion strengthening is negligibly small. Thus, the density of cementite in the ferrite grains is limited to 0.10 particle/$\mu m^2$ or less.

The volume fraction of cementite is about more than 5.9% and 8.0% or less when the C content is C: more than 0.40% and 0.53% or less and to about 2.5% or more and 5.9% or less when the C content is 0.20% or more and 0.40% or less. Even if balance microstructures such as pearlite are inevitably formed in addition to ferrite and cementite described above, the advantageous effects of disclosed embodiments are not impaired when the total volume fraction of the balance microstructures is about 5% or less. Thus, the steel sheet according to embodiments may include balance microstructures such as pearlite such that the total volume fraction of the balance microstructures is 5% or less.

3) Mechanical Properties

The steel sheet according to embodiments is required to have excellent formability since the steel sheet is formed into automotive parts such as a gear, a transmission, a seat recliner, and the like by cold pressing. It is also necessary to enhance wear resistance of the steel sheet by enhancing the hardness of the steel sheet by performing a quenching treatment. Accordingly, it is necessary to enhance the hardenability of the steel sheet, that is, produce a steel sheet having excellent hardenability, reduce the hardness of the steel sheet to 83 HRB or less, and increase the elongation El of the steel sheet to 30% or more. In the case where the steel sheet is required to have markedly excellent formability, it is necessary to set the hardness of the steel sheet to 75 HRB or less and increase the elongation El of the steel sheet to 38% or more. The lower the hardness of the steel sheet is, the more preferable from the viewpoint of formability. However, reducing the hardness of the steel sheet requires the annealing time to be increased, which increases the production cost. Accordingly, the hardness of the steel sheet is limited to more than 65 HRB. In order to increase the yield of the product, that is, the steel sheet, the variation in the HRB hardness of the steel sheet over the entire width thereof is preferably limited to 4 or less. Furthermore, the variation in the elongation of the steel sheet over the entire width thereof is preferably limited to 3% or less. The above-described mechanical properties can be achieved under the following production conditions. The "variation in HRB hardness" herein refers to the difference between the maximum HRB and the minimum HRB of the steel sheet in the width direction. The "variation in elongation" herein refers to the difference between the maximum total elongation and the minimum total elongation of the steel sheet in the width direction.

Examples of the quenching treatment include a water quenching treatment and an oil quenching treatment. In a water quenching treatment, for example, the pressed parts which above mentioned is heated to about 850° C. to 1050° C., kept for about 0.1 to 600 seconds, and immediately water-cooled. In an oil quenching treatment, for example, the pressed parts which above mentioned is heated to about 800° C. to 1050° C., kept for about 60 to 3600 seconds, and immediately oil-cooled. In the case where the steel sheet having a hardness of 83 HRB or less and a El of 30% or more is produced, it is considered that the steel sheet has excellent hardenability when the hardness of the steel sheet is increased to more than 620 in terms of Vickers hardness (HV) by performing a water quenching treatment in which, for example, the steel sheet is maintained at 870° C. for 30 s and immediately water-cooled. In the case where a steel sheet having a hardness of 75 HRB or less and a El of 38% or more is produced, it is considered that the steel sheet has excellent hardenability when the hardness of the steel sheet is increased to 440 or more and is further preferably increased to 500 or more in terms of Vickers hardness (HV) by performing a water quenching treatment in which, for example, the steel sheet is maintained at 870° C. for 30 s and immediately water-cooled. A steel sheet that has been subjected to the water quenching treatment or the oil quenching treatment has a martensite single-phase microstructure or a mixed microstructure of the martensite phase and the bainite phase.

4) Production Conditions

The high-carbon hot-rolled steel sheet according to embodiments is produced by subjecting a material, that is, a steel having the above-described composition, to a hot-rolling step in which the material is hot-rough-rolled and subsequently finish-rolled at a finishing temperature of the Ar3 transformation temperature or more and (Ar3 transformation temperature+90° C.) or less to prepare a hot-rolled steel sheet having a desired thickness, coiling at a coiling temperature of 500° C. or more and 700° C. or less, and subsequently annealing at the Ac1 transformation temperature or less. It is preferable to set the rolling reduction ratio of finish-rolling to 85% or more. It is preferable to use an edge heater in finish-rolling. It is further preferable to reduce the difference between the finishing temperature at the center of the steel sheet in the width direction and the finishing temperature at a position 10 mm from the edge of the steel sheet in the width direction to 40° C. or less using the edge heater.

The reasons for limiting the method for producing the high-carbon hot-rolled steel sheet according to embodiments are described below.

Finishing Temperature: Ar3 Transformation Temperature or More and (Ar3 Transformation Temperature+90° C.) or Less In the case where the C content is more than 0.40% and 0.53% or less, it is necessary to perform annealing using a hot-rolled steel sheet having a microstructure including pearlite and pro-eutectoid ferrite as a base material in order to set the density of cementite in the ferrite grains to 0.15 particle/$\mu m^2$ or less after annealing. In the case where the C content is 0.20% or more and 0.40% or less, it is necessary to perform annealing using a hot-rolled steel sheet having a microstructure including pearlite and pro-eutectoid ferrite as a base material in order to set the density of cementite in the ferrite grains to 0.10 particle/$\mu m^2$ or less after annealing. If the finishing temperature of hot rolling exceeds (Ar3 transformation temperature+90° C.), the proportion of the pro-eutectoid ferrite may become small, which makes it impossible to realize the predetermined cementite density after annealing. In other words, it becomes impossible to set the density of cementite in the ferrite grains to 0.15 particles/$\mu m^2$ or less when the C content in the steel is more than 0.40% and 0.53% or less and set the density of cementite in the ferrite grains to 0.10 particles/$\mu m^2$ or less when the C content in the steel is 0.20% or more and 0.40% or less. Accordingly, the finishing temperature is limited to (Ar3 transformation temperature+90° C.) or less. The finishing temperature is preferably set to (Ar3 transformation temperature+70° C.) or less in order to increase the proportion of pro-eutectoid ferrite to a sufficient degree. The finishing temperature is more preferably set to less than 850° C. or less than (Ar3 transformation temperature+50° C.). However, if the finishing temperature is less than the Ar3 transformation temperature, coarse ferrite grains may be formed after hot rolling and after annealing, which significantly reduces the elongation of the steel sheet. Accordingly, the finishing temperature is limited to the Ar3 transformation temperature or more. Note that, the term "finishing temperature" used herein refers to the temperature of the surface of the steel sheet which is measured at the center of the steel sheet in the width direction when completing finish-rolling.

Coiling Temperature: 500° C. or More and 700° C. or Less

After finish-rolling, the hot-rolled steel sheet is cooled and coiled at a coiling temperature of 500° C. or more and 700° C. or less. An excessively high coiling temperature is not preferable from an operational viewpoint because it may reduce the strength of the hot-rolled steel sheet excessively and, when the steel sheet is coiled, the resulting coil may deform due to its own weight. Thus, the upper limit of the coiling temperature is set to 700° C. On the other hand, an excessively low coiling temperature is not preferable because it may excessively increase the hardness of the hot-rolled steel sheet. Thus, the lower limit of the coiling temperature is set to 500° C.

Annealing Temperature: Ac1 Transformation Temperature or Less

If the annealing temperature exceeds the Ac1 transformation temperature, precipitation of austenite occurs and, while the steel sheet is cooled after annealing, a coarse pearlite microstructure may be formed, which results in nonuniformity of the microstructure. Accordingly, the annealing temperature is limited to the Ac1 transformation temperature or less. The lower limit of the annealing temperature is not particularly placed. However, in order to realize the predetermined density of cementite in the grains, the annealing temperature is preferably set to 600° C. or more and is more preferably set 700° C. or more. Note that, in the annealing treatment, any of a nitrogen gas, a hydrogen gas, and a mixed gas of nitrogen and hydrogen may be used as an atmosphere gas. While any of these gases can be used as an atmosphere gas in the annealing treatment, it is preferable to use a gas containing 90 vol % or more of nitrogen from the viewpoints of cost and safety. The annealing time is preferably set to 0.5 to 40 hours. If the annealing time is less than 0.5 hours, the effect of annealing may become small, which makes it difficult to form the targeted microstructure and to achieve the targeted hardness and elongation of the steel sheet. The annealing time is more preferably set to 10 hours or more. If the annealing time exceeds 40 hours, the productivity of the steel sheet may be degraded, which results in high production cost. Accordingly, the annealing time is preferably set to 40 hours or less.

Any of a converter and an electric furnace may be used for preparing a high-carbon molten steel according to embodiments. The high-carbon molten steel is formed into a slab by ingot casting-blooming or continuous casting. Commonly, the slab is heated and subsequently hot-rolled. In the case where the slab is formed by continuous casting, the slab may be subjected to direct rolling, in which the slab is directly rolled or in which heat retention is performed in order to suppress a reduction in the temperature of the slab before the slab is rolled. In the case where the slab is heated and then being hot-rolled, the slab-reheating temperature is preferably set to 1280° C. or less in order to prevent the conditions of the surface of the slab from being degraded due to scale. During hot rolling, the material to be rolled may be heated by heating means such as a sheet bar heater in order to achieve the predetermined finishing temperature.

In embodiments, an edge heater is preferably used in the finish-rolling step. During hot rolling and, in particular, finish-rolling in which the thickness of the steel sheet becomes thin, the finishing temperature is likely to be reduced in the vicinity of the edge of the steel sheet in the width direction (hereinafter, also referred to as "edge") compared with the center of the steel sheet in the width direction. Accordingly, it is preferable to increase the temperature at the edge of the steel sheet in the width direction using an edge heater during finish-rolling. A portion in the vicinity of the edge of the steel sheet in the width direction, that is, a portion of the steel sheet which extends from the edge of the steel sheet in the width direction to a position 10 mm from the edge toward the center of the steel sheet in the width direction, is rarely used as a material of a product. Therefore, it is preferable to heat the steel sheet using an edge heater such that the temperature at the portion that extends from the center of the steel sheet in the width direction to a position 10 mm from the edge (region between the center of the steel sheet in the width direction and a position 10 mm from the edge of the steel sheet in the width direction) is the Ar3 transformation temperature or more during finish-rolling. Note that, the expression "position 10 mm from the edge of the steel sheet in the width direction" herein refers to a position 10 mm from the edge of the steel sheet in the width direction toward the center of the steel sheet in the width direction.

If the variation in the finishing temperature of the steel sheet in the width direction is large, the hardness and elongation of the steel sheet are likely to vary. In particular, if the difference in finishing temperature of the steel sheet in the width direction exceeds 40° C., the variations in the hardness and elongation of the steel sheet may become large. Therefore, when increasing the temperature at the edge of the steel sheet in the width direction using an edge heater, it is preferable to reduce the difference between the finishing temperature at the center of the steel sheet in the width direction and the finishing temperature at a position 10 mm from the edge of the steel sheet in the width direction to 40° C. or less. The above-described difference in finishing temperature is more preferably reduced to 20° C. or less.

EXAMPLE 1

Molten steels were each produced from a specific one of the steels, that is, Steel Nos. HA to HJ, having the chemical compositions shown in Table 1. The slabs that made from above molten steels were hot-rolled under the respective production conditions shown in Table 2 (Tables 2-1 and 2-2) and subsequently pickled. Then, spheroidizing annealing was performed in a nitrogen atmosphere (atmosphere gas: mixed gas containing 95 vol % of nitrogen and the balance being hydrogen). Thus, hot-rolled steel sheets (hot-rolled annealed sheets) having a thickness of 4.0 mm and a width of 1000 mm were produced. Table 2 (Tables 2-1 and 2-2) shows the finishing temperature at the center of each steel sheet in the width direction and the finishing temperature at a position 10 mm from the edge of each steel sheet in the width direction. In the case where an edge heater was used, the difference between the finishing temperature at the center of the steel sheet in the width direction and the finishing temperature at a position 10 mm from the edge of the steel sheet in the width direction was set to 40° C. or less. The hot-rolled annealed sheets produced in the above-described manner were examined in terms of microstructure, hardness, elongation, and quench hardness. Table 2 (Tables 2-1 and 2-2) summarizes the results. The Ar3 transformation temperature and Ac1 transformation temperature shown in Table 1 were determined from thermal expansion curves. As shown in Table 1, the C contents in the steels used in Example 1 fell within the range of more than 0.40% and 0.53% or less.

Hardness (HRB) of Annealed Steel Sheet

A specimen was taken from each of the annealed steel sheets (original sheets) at the center of the steel sheet in the width direction. Measurement was made at five points using a Rockwell hardness tester (B scale), and the average thereof was calculated.

Specimens were also taken over the entire width of each of the annealed steel sheets with 40-mm pitches from the edge of the steel sheet in the width direction. For each specimen, measurement was made at five points using a Rockwell hardness tester (B scale), and the average of the five points was calculated in the above-described manner. The maximum and minimum among the averages of the specimens were determined. The difference therebetween was considered to be the variation in the hardness of the annealed steel sheet.

Elongation (El) of Annealed Steel Sheet

A JIS No. 5 test piece for tensile test was cut from each of the annealed steel sheets (original sheets) in a direction (L-direction) inclined at an angle of 0° to the rolling direction and subjected to a tensile test using a tensile testing machine "AG10TB AG/XR" produced by Shimadzu Corporation at 10 mm/min crosshead speed. Portions of the fractured specimen were butted against each other to measure the elongation of the specimen.

JIS No. 5 test pieces for tensile test were also taken over the entire width of each annealed steel sheet with 40-mm pitches from the edge of the steel sheet in the width direction in a direction (L-direction) inclined at an angle of 0° to the rolling direction. The elongation of each test piece was measured in the above-described manner, and the maximum and minimum were determined. The difference in the maximum and minimum was considered to be the variation in the elongation of the steel sheet.

Microstructure

In order to determine the microstructures of the annealed steel sheets, a specimen taken from each annealed steel sheet at the center of the steel sheet in the width direction was cut, the cut surface (cross section taken in the thickness direction, which is parallel to the rolling direction) of the specimen was polished and subsequently subjected to a nital corrosion treatment, and images of the microstructure were taken at five points at the ¼-thickness position of the steel sheet using a scanning electron microscope at a 3000-fold magnification. Using the photographs of microstructure, the density of cementite in the grains was determined by counting the number of cementite particles that were not located at the grain boundaries and had a major-axis diameter of 0.15 μm or more and dividing the number of such cementite particles by the area of the fields of view in the photographs.

For each annealed steel sheet, the difference between the nitrogen content in the 150 μm-surface layer and the average N content in the steel sheet and (solute B content)/(Added B content) were also determined in the following manner. Table 2 (Tables 2-1 and 2-2) shows the results.

Difference Between Nitrogen Content in 150 μm-Surface Layer and Average N Content in Steel Sheet Using a specimen taken from each annealed steel sheet at the center of the steel sheet in the width direction, the nitrogen content in the 150 μm-surface layer and the average N content in the steel sheet were measured, and the difference between the nitrogen content in the 150 μm-surface layer and the average N content in the steel sheet was calculated. The "nitrogen content in the 150 μm-surface layer" herein refers to the nitrogen content in a portion of the steel sheet which extended from the surface of the steel sheet to a depth of 150 μm in the thickness direction. The nitrogen content in the 150 μm-surface layer was determined in the following manner. The surface of the specimen taken from each steel sheet was cut until a depth of 150 μm from the surface of the specimen was reached. The chip generated by cutting in this period was taken as a sample. The N content in the sample was measured and considered to be the nitrogen content in the 150 μm-surface layer. The nitrogen content in the 150 μm-surface layer and the average N content in the steel sheet were measured by an inert gas transportation fusion-thermal conductivity method. It was considered that occurrence of nitriding was suppressed when the difference between the nitrogen content in the 150 μm-surface layer (nitrogen content in a portion extending from the surface to a depth of 150 μm from the surface) determined in the above-described manner and the average N content in the steel sheet (N content in the steel) was 30 mass ppm or less.

Solute B Content/Added B Content

In order to determine the solute B content, a specimen was taken from each annealed steel sheet at the center of the steel sheet in the width direction, BN contained in the steel sheet was extracted using 10 (vol %) Br-methanol, and the content of B forming BN was measured and subtracted from the total content of B added, that is, the B content in the steel. The ratio of the solute B content determined in the above-described manner to the content of B added (B content), that is, solute B content/added B content, was calculated. It was considered that a reduction in the solute B content was suppressed when {solute B content (mass %)/added B content (mass %)}×100(%) was 70(%) or more.

Hardness of Quenched Steel Sheet (Quench Hardness)

Flat test pieces (15 mm width×40 mm length×4 mm thickness) were taken from each annealed steel sheet at the width-direction center of the steel sheet and subjected to a quenching treatment by two methods, that is, by water cooling and oil cooling at 120° C. Then, the hardness of each of the steel sheets quenched by the two methods (quench hardness) were determined. In other words, the flat test pieces were each subjected to a quenching treatment in which the test piece was kept at 870° C. for 30 s and immediately water-cooled (water cooling) or the test piece was kept at 870° C. for 30 s and immediately oil-cooled by 120° C. oil (oil cooling at 120° C.). In order to determine quenching properties, hardness of each test piece that had been subjected to the quenching treatment was measured at five points on the cut surface of the test piece using a Vickers hardness tester at a load of 1 kgf, and the average hardness calculated was considered to be the quench hardness of the steel sheet. When both "Hardness after water-cooling" criterion and "Hardness after oil-cooling at 120° C." criterion described in Table 3 were satisfied, an evaluation of Pass (○) in terms of quench hardness was given. That is, it was considered that the steel sheet had excellent hardenability. When at least one of "Hardness after water-cooling" criterion and "Hardness after oil-cooling at 120° C." criterion described in Table 3 was not satisfied, an evaluation of Failure (×) in terms of quench hardness was given. That is, it was considered that the steel sheet had poor hardenability. Table 3 summarizes the quench hardness depending on the C content, at which sufficiently high hardenability is empirically considered to be achieved.

Table 1 and Table 2 (Tables 2-1 and 2-2) show that each of the hot-rolled steel sheets prepared in examples of disclosed embodiments has a microstructure constituted by ferrite and cementite and the density of cementite in the ferrite grains is 0.15 particle/$\mu m^2$ or less. In addition, each of the hot-rolled steel sheets produced in examples of disclosed embodiments has a hardness of 83 HRB or less and a total elongation of 30% or more, that is, excellent cold formability and excellent hardenability.

Specimen Nos. H1, H3, and H4, which are examples of disclosed embodiments produced using an edge heater and using the steel HA having the same composition as H5, have smaller variations in HRB hardness and total elongation in the width direction than Specimen No. H5, which is an example of disclosed embodiments produced without using an edge heater. In Specimen Nos. H1, H3, and H4, the variation in HRB hardness are 4 or less and the variation in total elongation are 3% or less. In Specimen No. H5, which was produced without using an edge heater, the difference between the finishing temperature at the center of the steel sheet in the width direction and the finishing temperature at a position 10 mm from the edge of the steel sheet in the width direction was 50° C.

TABLE 1

| Steel No. | Chemical composition (mass %) C | Si | Mn | P | S | sol. Al | N | B | Sb, Sn, Bi, Ge, Te, and Se | Others | Ac1 transformation temperature (° C.) | Ar3 transformation temperature (° C.) | Remarks |
|---|---|---|---|---|---|---|---|---|---|---|---|---|---|
| HA | 0.48 | 0.01 | 0.34 | 0.01 | 0.003 | 0.04 | 0.0033 | 0.0030 | Sb: 0.010 | — | 719 | 782 | Within range of embodiments |
| HB | 0.42 | 0.01 | 0.34 | 0.01 | 0.003 | 0.04 | 0.0041 | 0.0025 | Sb + Bi: 0.020 | — | 719 | 794 | Within range of embodiments |
| HC | 0.48 | 0.01 | 0.34 | 0.01 | 0.003 | 0.04 | 0.0033 | 0.0015 | Sb: 0.010 | — | 719 | 782 | Within range of embodiments |
| HD | 0.51 | 0.02 | 0.30 | 0.02 | 0.010 | 0.03 | 0.0033 | 0.0020 | Sb + Sn: 0.020 | Ni: 0.02 | 720 | 782 | Within range of embodiments |
| HE | 0.45 | 0.01 | 0.45 | 0.01 | 0.003 | 0.04 | 0.0033 | 0.0015 | Sb + Ge + Te + Se: 0.010 | — | 718 | 784 | Within range of embodiments |
| HF | 0.53 | 0.02 | 0.35 | 0.02 | 0.010 | 0.03 | 0.0033 | 0.0025 | Sb: 0.010 | Mo: 0.02 | 719 | 778 | Within range of embodiments |
| HG | 0.48 | 0.02 | 0.35 | 0.02 | 0.010 | 0.03 | 0.0033 | 0.0020 | Sb + Sn: 0.015 | Cr: 0.12 | 721 | 784 | Within range of embodiments |
| HH | 0.45 | 0.02 | 0.35 | 0.01 | 0.003 | 0.04 | 0.0033 | 0.0030 | Sb + Sn + Bi + Ge + Te + Se: 0.001 | — | 719 | 787 | Outside range of embodiments |
| HI | 0.48 | 0.02 | 0.35 | 0.01 | 0.003 | 0.04 | 0.0033 | 0.0002 | Sb: 0.010 | — | 719 | 782 | Outside range of embodiments |
| HJ | 0.51 | 0.19 | 0.70 | 0.02 | 0.002 | 0.04 | 0.0027 | 0.0030 | Sb: 0.005 | — | 721 | 782 | Outside range of embodiments |

TABLE 2-1

| Specimen No. | Steel No. | Ac1 transformation temperature (° C.) | Ar3 transformation temperature (° C.) | Ar3 + 90 (° C.) | Hot-rolling conditions: Finishing temperature at center of sheet in width direction (° C.) * | Finishing temperature at edge of sheet in width direction (° C.) ** | Difference in finishing temperature (° C.) *** | Coiling temperature (° C.) | Use of edge heater | Annealing temperature (° C.) | Annealing time (h) | Microstructure | Densityof cementite in ferrite grains (particle/μm$^2$) |
|---|---|---|---|---|---|---|---|---|---|---|---|---|---|
| H1 | HA | 719 | 782 | 872 | 830 | 810 | 20 | 600 | Yes | 715 | 30 | Ferrite + cementite | 0.12 |
| H2 | HA | 719 | 782 | 872 | 930 | 910 | 20 | 600 | Yes | 715 | 30 | Ferrite + cementite | 0.20 |
| H3 | HA | 719 | 782 | 872 | 845 | 825 | 20 | 600 | Yes | 715 | 30 | Ferrite + cementite | 0.11 |
| H4 | HA | 719 | 782 | 872 | 825 | 800 | 25 | 580 | Yes | 715 | 30 | Ferrite + cementite | 0.09 |
| H5 | HA | 719 | 782 | 872 | 825 | 775 | 50 | 580 | No | 715 | 30 | Ferrite + cementite | 0.09 |
| H6 | HB | 719 | 794 | 884 | 840 | 815 | 25 | 600 | Yes | 715 | 30 | Ferrite + cementite | 0.07 |
| H7 | HB | 719 | 794 | 884 | 840 | 810 | 30 | 660 | Yes | 715 | 30 | Ferrite + cementite | 0.07 |
| H8 | HB | 719 | 794 | 884 | 830 | 805 | 25 | 610 | Yes | 715 | 30 | Ferrite + cementite | 0.08 |
| H9 | HB | 719 | 794 | 884 | 860 | 835 | 25 | 610 | Yes | 715 | 30 | Ferrite + cementite | 0.10 |
| H10 | HC | 719 | 782 | 872 | 830 | 810 | 20 | 600 | Yes | 715 | 25 | Ferrite + cementite | 0.05 |
| H11 | HC | 719 | 782 | 872 | 845 | 820 | 25 | 550 | Yes | 715 | 25 | Ferrite + cementite | 0.04 |

| Specimen No. | Hardness of original sheet at center of sheet (HRB) | Variation in hardness of original sheet in width direction (HRB) | Elongation of original sheet at center of sheet (%) | Variation in elongation in width direction of sheet (%) | Difference between N concentration at 150 μm-surface layer and average N concentration in steel sheet (mass ppm) | Solute B content (mass %) | Solute B content/added B content × 100 (%) | Quench hardness (HV): Water cooling | Quench hardness (HV): 120° C. oil cooling | Hardenability evaluation | Remarks |
|---|---|---|---|---|---|---|---|---|---|---|---|
| H1 | 75 | 1 | 36 | 1.5 | 20 | 0.0025 | 83 | 690 | 610 | ○ | Example |
| H2 | 80 | 2 | 29 | 2.0 | 20 | 0.0025 | 83 | 695 | 615 | ○ | Comparative example |
| H3 | 76 | 2 | 36 | 2.0 | 20 | 0.0026 | 87 | 692 | 605 | ○ | Example |
| H4 | 75 | 1 | 36 | 1.0 | 10 | 0.0025 | 83 | 685 | 604 | ○ | Example |

TABLE 2-1-continued

| | | | | | | | | | | | |
|---|---|---|---|---|---|---|---|---|---|---|---|
| H5 | 75 | 6 | 35 | 5.0 | 10 | 0.0025 | 83 | 685 | 605 | ○ | Example |
| H6 | 73 | 2 | 37 | 1.5 | 10 | 0.0025 | 83 | 630 | 573 | ○ | Example |
| H7 | 73 | 2 | 38 | 1.5 | 10 | 0.0025 | 83 | 635 | 578 | ○ | Example |
| H8 | 72 | 2 | 37 | 2.0 | 20 | 0.0024 | 80 | 640 | 572 | ○ | Example |
| H9 | 75 | 2 | 37 | 2.0 | 20 | 0.0022 | 73 | 635 | 575 | ○ | Example |
| H10 | 76 | 1 | 36 | 1.5 | 20 | 0.0012 | 80 | 685 | 605 | ○ | Example |
| H11 | 77 | 1 | 35 | 1.5 | 20 | 0.0012 | 80 | 680 | 603 | ○ | Example |

* Finishing temperature at the center of the sheet in the width direction

** Finishing temperature at a position 10 mm from the edge of the sheet in the width direction

*** Difference between the finishing temperature at the center of the sheet in the width direction and the finishing temperature at a position 10 mm from the edge of the sheet in the width direction

TABLE 2- 2

| Specimen No. | Steel No. | Ac1 transformation temperature (° C.) | Ar3 transformation temperature (° C.) | Ar3 + 90 (° C.) | Hot-rolling conditions: Finishing temperature at center of sheet in width direction (° C.) * | Finishing temperature at edge of sheet in width direction (° C.) ** | Difference in finishing temperature (° C.) *** | Coiling temperature (° C.) | Use of edge heater | Annealing temperature (° C.) | Annealing time (h) | Microstructure | Density of cementite in ferrite grains (particle/μm$^2$) |
|---|---|---|---|---|---|---|---|---|---|---|---|---|---|
| H12 | HD | 720 | 782 | 872 | 830 | 810 | 20 | 600 | Yes | 715 | 25 | Ferrite + cementite | 0.05 |
| H13 | HE | 718 | 784 | 874 | 805 | 785 | 20 | 600 | Yes | 715 | 25 | Ferrite + cementite | 0.05 |
| H14 | HF | 719 | 778 | 868 | 825 | 800 | 25 | 620 | Yes | 715 | 30 | Ferrite + cementite | 0.06 |
| H15 | HG | 721 | 784 | 874 | 830 | 810 | 20 | 560 | Yes | 715 | 30 | Ferrite + cementite | 0.06 |
| H16 | HH | 719 | 787 | 877 | 835 | 810 | 25 | 600 | Yes | 715 | 30 | Ferrite + cementite | 0.05 |
| H17 | HI | 719 | 782 | 872 | 830 | 810 | 20 | 600 | Yes | 715 | 30 | Ferrite + cementite | 0.05 |
| H18 | HJ | 721 | 782 | 872 | 830 | 810 | 20 | 600 | Yes | 715 | 30 | Ferrite + cementite | 0.12 |

| Specimen No. | Hardness of original sheet at center of sheet (HRB) | Variation in hardness of original sheet in width direction (HRB) | Elongation of original sheet at center of sheet (%) | Variation in elongation in width direction of sheet (%) | Difference between N concentration at 150 μm-surface layer and average N concentration in steel sheet (mass ppm) | Solute B content (mass %) | Solute B content/ added B content × 100 (%) | Quench hardness (HV): Water cooling | Quench hardness (HV): 120° C. oil cooling | Hardenability evaluation | Remarks |
|---|---|---|---|---|---|---|---|---|---|---|---|
| H12 | 77 | 1 | 36 | 1.5 | 10 | 0.002 | 80 | 720 | 670 | ○ | Example |
| H13 | 72 | 2 | 38 | 2.0 | 15 | 0.0024 | 80 | 655 | 585 | ○ | Example |
| H14 | 78 | 2 | 32 | 2.0 | 20 | 0.0020 | 80 | 750 | 690 | ○ | Example |
| H15 | 75 | 2 | 33 | 2.0 | 20 | 0.0015 | 75 | 690 | 685 | ○ | Example |
| H16 | 72 | 2 | 35 | 2.0 | 200 | 0.0004 | 13 | 670 | 500 | x | Comparative example |
| H17 | 75 | 2 | 35 | 2.0 | 20 | 0.0001 | 50 | 680 | 500 | x | Comparative example |
| H18 | 84 | 2 | 28 | 2.0 | 20 | 0.0025 | 83 | 720 | 640 | ○ | Comparative example |

* Finishing temperature at the center of the sheet in the width direction

** Finishing temperature at a position 10 mm from the edge of the sheet in the width direction

*** Difference between the finishing temperature at the center of the sheet in the width direction and the finishing temperature at a position 10 mm from the edge of the sheet in the width direction

TABLE 3

| C content (mass %) | Hardness after water-cooling (HV) | Hardness after oil-cooling at 120° C. (HV) |
|---|---|---|
| More than 0.40 and less than 0.42 | >620 | >550 |
| 0.42 or more and less than 0.45 | ≥630 | ≥560 |
| 0.45 or more and less than 0.48 | ≥650 | ≥580 |
| 0.48 or more and less than 0.51 | ≥670 | ≥600 |
| 0.51 or more and less than 0.53 | ≥700 | ≥630 |
| 0.53 | ≥740 | ≥670 |

EXAMPLE 2

Molten steels were each produced from a specific one of the steels, that is, Steel Nos. LA to LJ, having the chemical compositions shown in Table 4. The slabs that made from above molten steels were hot-rolled under the respective production conditions shown in Table 5 (Tables 5-1 and 5-2) and subsequently pickled. Then, spheroidizing annealing was performed in a nitrogen atmosphere (atmosphere gas: mixed gas containing 95 vol % of nitrogen and the balance being hydrogen). Thus, hot-rolled steel sheets (hot-rolled annealed sheets) having a thickness of 4.0 mm and a width of 1000 mm were produced. Table 5 (Tables 5-1 and 5-2) summarizes the finishing temperature at the center of each steel sheet in the width direction and the finishing temperature at a position 10 mm from the edge of each steel sheet in the width direction. In the case where an edge heater was used, the difference between the finishing temperature at the center of the steel sheet in the width direction and the finishing temperature at a position 10 mm from the edge of the steel sheet in the width direction was set to 40° C. or less. The hot-rolled annealed sheets produced in the above-described manner were examined in terms of microstructure, hardness, elongation, and quench hardness as in Example 1. Table 5 (Tables 5-1 and 5-2) summarizes the results. The Ar3 transformation temperature and Ac1 transformation temperature shown in Table 4 were determined from thermal expansion curves. As shown in Table 4, the C contents in the steels used in Example 2 fell within the range of 0.20% or more and 0.40% or less.

Hardness (HRB) of Annealed Steel Sheet

A specimen was taken from each of the annealed steel sheets (original sheets) at the center of the steel sheet in the width direction. Measurement was made at five points using a Rockwell hardness tester (B scale), and the average thereof was calculated.

Specimens were also taken over the entire width of each of the annealed steel sheets with 40-mm pitches from the edge of the steel sheet in the width direction. For each specimen, measurement was made at five points using a Rockwell hardness tester (B scale), and the average of the five points was calculated in the above-described manner. The maximum and minimum among the averages of the specimens were determined. The difference therebetween was considered to be the variation in the hardness of the annealed steel sheet.

Elongation (El) of Annealed Steel Sheet

A JIS No. 5 test piece for tensile test was cut from each of the annealed steel sheets (original sheets) in a direction (L-direction) inclined at an angle of 0° to the rolling direction and subjected to a tensile test using a tensile testing machine "AG10TB AG/XR" produced by Shimadzu Corporation at 10 mm/min crosshead speed. Portions of the fractured specimen were butted against each other to measure the elongation of the specimen.

JIS No. 5 test pieces for tensile test were also taken over the entire width of each annealed steel sheet with 40-mm pitches from the edge of the steel sheet in the width direction in a direction (L-direction) inclined at an angle of 0° to the rolling direction. The elongation of each test piece was measured in the above-described manner, and the maximum and minimum were determined. The difference in the maximum and minimum was considered to be the variation in the elongation of the steel sheet.

Microstructure

In order to determine the microstructures of the annealed steel sheets, a specimen taken from each annealed steel sheet at the center of the steel sheet in the width direction was cut, the cut surface (cross section taken in the thickness direction, which is parallel to the rolling direction) of the specimen was polished and subsequently subjected to a nital corrosion treatment, and images of the microstructure were taken at five points at the ¼-thickness position of the steel sheet using a scanning electron microscope at a 3000-fold magnification. Using the photographs of microstructure, the density of cementite in the grains was determined by counting the number of cementite particles that were not located at the grain boundaries and had a major-axis diameter of 0.15 μm or more and dividing the number of such cementite particles by the area of the fields of view in the photographs.

For each annealed steel sheet, as in Example 1, the difference between the nitrogen content in the 150 μm-surface layer and the average N content in the steel sheet and (solute B content)/(added B content) were also determined in the following manner. Table 5 (Tables 5-1 and 5-2) shows the results.

Difference Between Nitrogen Content in 150 μm-Surface Layer and Average N Content in Steel Sheet Using a specimen taken from each annealed steel sheet at the center of the steel sheet in the width direction, the nitrogen content in the 150 μm-surface layer and the average N content in the steel sheet were measured, and the difference between the nitrogen content in the 150 μm-surface layer and the average N content in the steel sheet was calculated. The "nitrogen content in the 150 μm-surface layer" herein refers to the nitrogen content in a portion of the steel sheet which extended from the surface of the steel sheet to a depth of 150 μm in the thickness direction. The nitrogen content in the 150 μm-surface layer was determined in the following manner. The surface of the specimen taken from each steel sheet was cut until a depth of 150 μm from the surface of the specimen was reached. The chip generated by cutting in this period was taken as a sample. The N content in the sample was measured and considered to be the nitrogen content in the 150 μm-surface layer. The nitrogen content in the 150 μm-surface layer and the average N content in the steel sheet were measured by an inert gas transportation fusion-thermal conductivity method. It was considered that occurrence of nitriding was suppressed when the difference between the nitrogen content in the 150 μm-surface layer (nitrogen content in a portion extending from the surface to a depth of 150 μm from the surface) determined in the above-described manner and the average N content in the steel sheet (N content in the steel) was 30 mass ppm or less.

Solute B Content/Added B Content

In order to determine the solute B content, a specimen was taken from each annealed steel sheet at the center of the steel sheet in the width direction, BN contained in the steel sheet was extracted using 10 (vol %) Br-methanol, and the content of B forming BN was measured and subtracted from the total content of B added, that is, the B content in the steel. The ratio of the solute B content determined in the above-described manner to the content of B added (B content), that is, solute B content/added B content, was calculated. It was considered that a reduction in the solute B content was suppressed when {solute B content (mass %)/added B content (mass %)}×100(%) was 70(%) or more.

Hardness of Quenched Steel Sheet (Quench Hardness)

Flat test pieces (15 mm width×40 mm length×4 mm thickness) were taken from each annealed steel sheet at the width-direction center of the steel sheet as in Example 1 and subjected to a quenching treatment by two methods, that is, by water cooling and oil cooling at 120° C. Then, the hardness of each of the steel sheets quenched by the two methods (quench hardness) were determined. In other words, the flat test pieces were each subjected to a quenching treatment in which the test piece was maintained at 870° C. for 30 s and immediately water-cooled (water cooling) or the test piece was maintained at 870° C. for 30 s and immediately oil-cooled by 120° C. oil (oil cooling at 120° C.) In order to determine quenching properties, hardness of each test piece that had been subjected to the quenching treatment was measured at five points on the cut surface of the test piece using a Vickers hardness tester at a load of 1 kgf, and the average hardness calculated was considered to be the quench hardness of the steel sheet. When both "Hardness after water-cooling" criterion and "Hardness after oil-cooling at 120° C." criterion described in Table 6 were satisfied, an evaluation of Pass (○) in terms of quench hardness was given. That is, it was considered that the steel sheet had excellent hardenability. When at least one of "Hardness after water-cooling" criterion and "Hardness after oil-cooling at 120° C." criterion described in Table 6 was not satisfied, an evaluation of Failure (×) in terms of quench hardness was given. That is, it was considered that the steel sheet had poor hardenability. Table 6 summarizes the quench hardness depending on the C content, at which sufficiently high hardenability is empirically considered to be achieved.

Table 4 and Table 5 (Tables 5-1 and 5-2) show that each of the hot-rolled steel sheets prepared in examples of disclosed embodiments, which has a C content of 0.20% or more and 0.40% or less, has a microstructure constituted by ferrite and cementite and the density of cementite in the ferrite grains is 0.10 particle/$\mu m^2$ or less. In addition, each of the hot-rolled steel sheets prepared in examples of disclosed embodiments has a hardness of 75 HRB or less and a total elongation of 38% or more, that is, excellent cold formability and excellent hardenability.

Specimen Nos. L1, L3, and L4, which are examples of disclosed embodiments produced using an edge heater and using the steel LA having the same composition as L5, have smaller variations in HRB hardness and total elongation in the width direction than Specimen No. L5, which is an example of disclosed embodiments produced without using an edge heater. In Specimen Nos. L1, L3, and L4, the variation in HRB hardness are 4 or less and the variation in total elongation are 3% or less. In Specimen No. L5, which was produced without using an edge heater, the difference between the finishing temperature at the center of the steel sheet in the width direction and the finishing temperature at a position 10 mm from the edge of the steel sheet in the width direction was 50° C.

TABLE 4

| Steel No. | Chemical composition (mass %) C | Si | Mn | P | S | sol. Al | N | B | Sb, Sn, Bi, Ge, Te, and Se | Others | Ac1 transformation temperature (° C.) | Ar3 transformation temperature (° C.) | Remarks |
|---|---|---|---|---|---|---|---|---|---|---|---|---|---|
| LA | 0.35 | 0.01 | 0.34 | 0.01 | 0.003 | 0.04 | 0.0033 | 0.0030 | Sb: 0.010 | — | 722 | 803 | Within range of embodiments |
| LB | 0.35 | 0.01 | 0.34 | 0.01 | 0.003 | 0.04 | 0.0041 | 0.0030 | Sb + Bi: 0.020 | — | 722 | 803 | Within range of embodiments |
| LC | 0.35 | 0.01 | 0.34 | 0.01 | 0.003 | 0.04 | 0.0033 | 0.0015 | Sb: 0.010 | — | 722 | 803 | Within range of embodiments |
| LD | 0.20 | 0.02 | 0.30 | 0.02 | 0.010 | 0.03 | 0.0033 | 0.0025 | Sb + Sn: 0.020 | Ni: 0.02 | 725 | 836 | Within range of embodiments |
| LE | 0.35 | 0.01 | 0.45 | 0.01 | 0.003 | 0.04 | 0.0033 | 0.0030 | Sb + Ge + Te + Se: 0.010 | — | 719 | 800 | Within range of embodiments |
| LF | 0.38 | 0.02 | 0.35 | 0.02 | 0.010 | 0.03 | 0.0033 | 0.0025 | Sb: 0.010 | Mo: 0.02 | 722 | 801 | Within range of embodiments |
| LG | 0.40 | 0.02 | 0.35 | 0.02 | 0.010 | 0.03 | 0.0033 | 0.0020 | Sb + Sn: 0.015 | Cr: 0.12 | 723 | 796 | Within range of embodiments |
| LH | 0.35 | 0.02 | 0.35 | 0.01 | 0.003 | 0.04 | 0.0033 | 0.0030 | Sb + Sn + Bi + Ge + Te + Se: 0.001 | — | 723 | 803 | Outside range of embodiments |
| LI | 0.35 | 0.02 | 0.35 | 0.01 | 0.003 | 0.04 | 0.0033 | 0.0002 | Sb: 0.010 | — | 722 | 803 | Outside range of embodiments |
| LJ | 0.35 | 0.19 | 0.70 | 0.02 | 0.002 | 0.04 | 0.0027 | 0.0030 | Sb: 0.005 | — | 722 | 807 | Outside range of embodiments |

TABLE 5 -1

| Specimen No. | Steel No. | Ac1 transformation temperature (° C.) | Ar3 transformation temperature (° C.) | Ar3 + 90 (° C.) | Hot-rolling conditions: Finishing temperature at center of sheet in width direction (° C.) * | Finishing temperature at edge of sheet in width direction (° C.) ** | Difference in finishing temperature (° C.) *** | Coiling temperature (° C.) | Use of edge heater | Annealing temperature (° C.) | Annealing time (h) | Microstructure | Density of cementite in ferrite grains (particle/μm$^2$) |
|---|---|---|---|---|---|---|---|---|---|---|---|---|---|
| L1 | LA | 722 | 803 | 893 | 860 | 830 | 30 | 600 | Yes | 715 | 30 | Ferrite + cementite | 0.07 |
| L2 | LA | 722 | 803 | 893 | 930 | 900 | 30 | 600 | Yes | 715 | 30 | Ferrite + cementite | 0.14 |
| L3 | LA | 722 | 803 | 893 | 845 | 820 | 25 | 600 | Yes | 715 | 30 | Ferrite + cementite | 0.06 |
| L4 | LA | 722 | 803 | 893 | 835 | 815 | 20 | 580 | Yes | 715 | 30 | Ferrite + cementite | 0.04 |
| L5 | LA | 722 | 803 | 893 | 835 | 785 | 50 | 580 | No | 715 | 30 | Ferrite + cementite | 0.04 |
| L6 | LB | 722 | 803 | 893 | 850 | 820 | 30 | 600 | Yes | 715 | 25 | Ferrite + cementite | 0.05 |
| L7 | LB | 722 | 803 | 893 | 845 | 820 | 25 | 610 | Yes | 715 | 25 | Ferrite + cementite | 0.05 |
| L8 | LB | 722 | 803 | 893 | 870 | 850 | 20 | 610 | Yes | 715 | 30 | Ferrite + cementite | 0.08 |
| L9 | LB | 722 | 803 | 893 | 890 | 870 | 20 | 610 | Yes | 715 | 30 | Ferrite + cementite | 0.10 |
| L10 | LC | 722 | 803 | 893 | 850 | 830 | 20 | 600 | Yes | 715 | 25 | Ferrite + cementite | 0.05 |
| L11 | LC | 722 | 803 | 893 | 845 | 820 | 25 | 550 | Yes | 715 | 25 | Ferrite + cementite | 0.04 |

| Specimen No. | Hardness of original sheet at center of sheet (HRB) | Variation in hardness of original sheet in width direction (HRB) | Elongation of original sheet at center of sheet (%) | Variation in elongation in width direction of sheet (%) | Difference between N concentration at 150 μm-surface layer and average N concentration in steel sheet (mass ppm) | Solute B content (mass %) | Solute B content/added B content × 100 (%) | Quench hardness (HV): Water cooling | Quench hardness (HV): 120° C. oil cooling | Hardenability evaluation | Remarks |
|---|---|---|---|---|---|---|---|---|---|---|---|
| L1 | 71 | 1 | 42 | 1.5 | 20 | 0.0025 | 83 | 607 | 558 | ○ | Example |
| L2 | 76 | 2 | 36 | 2.0 | 20 | 0.0025 | 83 | 605 | 578 | ○ | Comparative example |
| L3 | 69 | 2 | 42 | 2.0 | 20 | 0.0026 | 87 | 605 | 555 | ○ | Example |
| L4 | 68 | 1 | 43 | 1.0 | 10 | 0.0025 | 83 | 605 | 560 | ○ | Example |

TABLE 5 -1-continued

| | | | | | | | | | | | |
|---|---|---|---|---|---|---|---|---|---|---|---|
| L5 | 68 | 6 | 43 | 5.0 | 10 | 0.0025 | 83 | 605 | 561 | ○ | Example |
| L6 | 71 | 2 | 41 | 1.5 | 10 | 0.0025 | 83 | 610 | 573 | ○ | Example |
| L7 | 69 | 2 | 41 | 1.5 | 10 | 0.0025 | 83 | 610 | 573 | ○ | Example |
| L8 | 72 | 2 | 40 | 2.0 | 20 | 0.0024 | 80 | 610 | 573 | ○ | Example |
| L9 | 75 | 2 | 38 | 2.0 | 20 | 0.0022 | 73 | 610 | 573 | ○ | Example |
| L10 | 69 | 1 | 40 | 1.5 | 20 | 0.0012 | 80 | 605 | 541 | ○ | Example |
| L11 | 69 | 1 | 40 | 1.5 | 20 | 0.0012 | 80 | 605 | 541 | ○ | Example |

* Finishing temperature at the center of the sheet in the width direction

** Finishing temperature at a position 10 mm from the edge of the sheet in the width direction

*** Difference between the finishing temperature at the center of the sheet in the width direction and the finishing temperature at a position 10 mm from the edge of the sheet in the width direction

TABLE 5-2

| Specimen No. | Steel No. | Ac1 transformation temperature (° C.) | Ar3 transformation temperature (° C.) | Ar3 + 90 (° C.) | Hot-rolling conditions: Finishing temperature at center of sheet in width direction (° C.) * | Finishing temperature at edge of sheet in width direction (° C.) ** | Difference in finishing temperature (° C.) *** | Coiling temperature (° C.) | Use of edge heater | Annealing temperature (° C.) | Annealing time (h) | Microstructure | Density of cementite in ferrite grains (particle/μm$^2$) |
|---|---|---|---|---|---|---|---|---|---|---|---|---|---|
| L12 | LD | 725 | 836 | 926 | 850 | 840 | 10 | 600 | Yes | 715 | 30 | Ferrite + cementite | 0.05 |
| L13 | LE | 719 | 800 | 890 | 845 | 820 | 25 | 600 | Yes | 715 | 30 | Ferrite + cementite | 0.05 |
| L14 | LF | 722 | 801 | 891 | 840 | 820 | 20 | 620 | Yes | 715 | 30 | Ferrite + cementite | 0.06 |
| L15 | LG | 723 | 796 | 886 | 840 | 820 | 20 | 560 | Yes | 715 | 30 | Ferrite + cementite | 0.06 |
| L16 | LH | 723 | 803 | 893 | 850 | 830 | 20 | 600 | Yes | 715 | 30 | Ferrite + cementite | 0.05 |
| L17 | LI | 722 | 803 | 893 | 850 | 830 | 20 | 600 | Yes | 715 | 30 | Ferrite + cementite | 0.05 |
| L18 | LJ | 722 | 807 | 897 | 850 | 830 | 20 | 600 | Yes | 715 | 30 | Feritte + cementite | 0.09 |

| Specimen No. | Hardness of original sheet at center of sheet (HRB) | Variation in hardness of original sheet in width direction (HRB) | Elongation of original sheet at center of sheet (%) | Variation in elongation in width direction of sheet (%) | Difference between N concentration at 150 μm-surface layer and average N concentration in steel sheet (mass ppm) | Solute B content (mass %) | Solute B content/added B content × 100 (%) | Quench hardness (HV): Water cooling | Quench hardness (HV): 120° C. oil cooling | Hardenability evaluation | Remarks |
|---|---|---|---|---|---|---|---|---|---|---|---|
| L12 | 69 | 1 | 41 | 1.5 | 10 | 0.002 | 80 | 450 | 400 | ○ | Example |
| L13 | 72 | 2 | 40 | 2.0 | 15 | 0.0024 | 80 | 610 | 570 | ○ | Example |
| L14 | 75 | 2 | 36 | 2.0 | 20 | 0.002 | 80 | 615 | 540 | ○ | Example |
| L15 | 75 | 2 | 38 | 2.0 | 20 | 0.0015 | 75 | 615 | 590 | ○ | Example |
| L16 | 69 | 2 | 40 | 2.0 | 200 | 0.0004 | 13 | 602 | 400 | x | Comparative example |
| L17 | 69 | 2 | 40 | 2.0 | 20 | 0.0001 | 50 | 601 | 380 | x | Comparative example |
| L18 | 79 | 2 | 34 | 2.0 | 20 | 0.0025 | 83 | 610 | 450 | x | Comparative example |

* Finishing temperature at the center of the sheet in the width direction

** Finishing temperature at a position 10 mm from the edge of the sheet in the width direction

*** Difference between the finishing temperature at the center of the sheet in the width direction and the finishing temperature at a position 10 mm from the edge of the sheet in the width direction

TABLE 6

| C content (mass %) | Hardness after water-cooling (HV) | Hardness after oil-cooling at 120° C. (HV) |
|---|---|---|
| 0.20 or more and less than 0.35 | ≥440 | ≥360 |
| 0.35 or more and less than 0.38 | ≥600 | ≥530 |
| 0.38 or more and less than 0.40 | ≥610 | ≥540 |
| 0.40 | ≥620 | ≥550 |

The invention claimed is:

1. A high-carbon hot-rolled steel sheet, the steel sheet having a composition comprising:

C: more than 0.40% and 0.53% or less, by mass %;
Si: 0.10% or less, by mass %;
Mn: 0.50% or less, by mass %;
P: 0.03% or less, by mass %;
S: 0.010% or less, by mass %;
acid-soluble Al: 0.10% or less, by mass %;
N: 0.0050% or less, by mass %;
B: 0.0005% or more and 0.0050% or less, by mass %;
one or more elements selected from Sb, Sn, Bi, Ge, Te, and Se such that the total content of the one or more elements is in the range of 0.002% or more and 0.030% or less, by mass %; and
the balance comprising Fe and incidental impurities,
wherein the high-carbon hot-rolled steel sheet has (i) a microstructure including ferrite and cementite, a density of the cementite in the ferrite grains being in the range of 0.15 particle/$\mu m^2$ or less, (ii) a hardness in the range of more than 65 HRB and 83 HRB or less, and (iii) a total elongation in the range of 30% or more.

2. The high-carbon hot-rolled steel sheet according to claim 1, wherein the composition further comprises at least one element selected from Ni, Cr, and Mo such that the total content of the at least one element is in the range of 0.50% or less, by mass %.

3. The high-carbon hot-rolled steel sheet according to claim 1, wherein a variation in HRB hardness in a width direction of the steel sheet is in the range of 4 or less and a variation in total elongation in the width direction of the steel sheet is in the range of 3% or less.

4. A method for producing a high-carbon hot-rolled steel sheet, the method comprising:

subjecting to hot-rough-rolling a steel having a composition comprising:
C: more than 0.40% and 0.53% or less, by mass %;
Si: 0.10% or less, by mass %;
Mn: 0.50% or less, by mass %;
P: 0.03% or less, by mass %;
S: 0.010% or less, by mass %;
acid-soluble Al: 0.10% or less, by mass %;
N: 0.0050% or less, by mass %;
B: 0.0005% or more and 0.0050% or less, by mass %;
one or more elements selected from Sb, Sn, Bi, Ge, Te, and Se such that the total content of the one or more elements is in the range of 0.002% or more and 0.030% or less, by mass %; and
the balance comprising Fe and incidental impurities;
finish-rolling at a finishing temperature in the range of the Ar3 transformation temperature or more and (the Ar3 transformation temperature plus 90° C.) or less;
coiling at a coiling temperature in the range of 500° C. or more and 700° C. or less; and
annealing at a temperature equal to the Ac1 transformation temperature or less, thereby producing the high-carbon hot-rolled steel sheet,
wherein the high-carbon hot-rolled steel sheet has (i) a microstructure including ferrite and cementite, a density of the cementite in the ferrite grains being in the range of 0.15 particle/$\mu m^2$ or less, (ii) a hardness in the range of more than 65 HRB and 83 HRB or less, and (iii) a total elongation in the range of 30% or more.

5. The method for producing a high-carbon hot-rolled steel sheet according to claim 4, wherein the composition further comprises at least one element selected from Ni, Cr, and Mo such that the total content of the at least one element is in the range of 0.50% or less, by mass %.

6. The method for producing a high-carbon hot-rolled steel sheet according to claim 4, wherein an edge heater is used in the finish-rolling.

7. The method for producing a high-carbon hot-rolled steel sheet according to claim 6, wherein, in the finish-rolling, the difference between a finishing temperature at a center of the steel sheet in a width direction thereof and a finishing temperature at a position 10 mm from an edge of the steel sheet in the width direction thereof is in the range of 40° C. or less using the edge heater.

8. The high-carbon hot-rolled steel sheet according to claim 2, wherein a variation in HRB hardness in a width direction of the steel sheet is in the range of 4 or less and a variation in total elongation in the width direction of the steel sheet is in the range of 3% or less.

9. The method for producing a high-carbon hot-rolled steel sheet according to claim 5, wherein an edge heater is used in the finish-rolling.

10. The method for producing a high-carbon hot-rolled steel sheet according to claim 9, wherein, in the finish-rolling, a difference between a finishing temperature at a center of the steel sheet in a width direction thereof and a finishing temperature at a position 10 mm from an edge of the steel sheet in the width direction thereof is in the range of 40° C. or less using the edge heater.

* * * * *